United States Patent [19]

Buell et al.

[11] Patent Number: 4,506,971

[45] Date of Patent: Mar. 26, 1985

[54] TRANSFER SYSTEM

[75] Inventors: Kenneth C. Buell, Fairport; Thomas F. Cooper, Rochester, both of N.Y.

[73] Assignee: Xerox Corporation, Stamford, Conn.

[21] Appl. No.: 962,819

[22] Filed: Nov. 22, 1978

[51] Int. Cl.[3] ..... G03G 15/16

[52] U.S. Cl. ..... 355/3 TR; 355/3 R

[58] Field of Search ..... 355/3 R, 3 TR, 3 CH

[56] References Cited

U.S. PATENT DOCUMENTS

| | | | |
|---|---|---|---|
| 2,959,153 | 11/1960 | Hider | 355/3 R X |
| 3,784,300 | 1/1974 | Hudson et al. | 355/3 R |
| 3,984,182 | 10/1976 | Gundlach et al. | 355/3 R |
| 4,039,257 | 8/1977 | Connolly | 355/3 R |

FOREIGN PATENT DOCUMENTS 989930 5/1976 Canada .

*Primary Examiner*—Fred L. Braun

[57] ABSTRACT

To minimize or eliminate a blurred image in xerographic reproduction prior to transfer, a developed image on a charged photoreceptor is first exposed to light to at least substantially discharge the background around the image and to reduce the charge on the photoreceptor holding the image on the photoreceptor, and then a charge opposite to the polarity of the charged photoreceptor is deposited onto the image and photoreceptor. This produces a very stable image for transfer since a very strong holding force is produced to hold the image in place as the image enters a transfer station.

3 Claims, 1 Drawing Figure

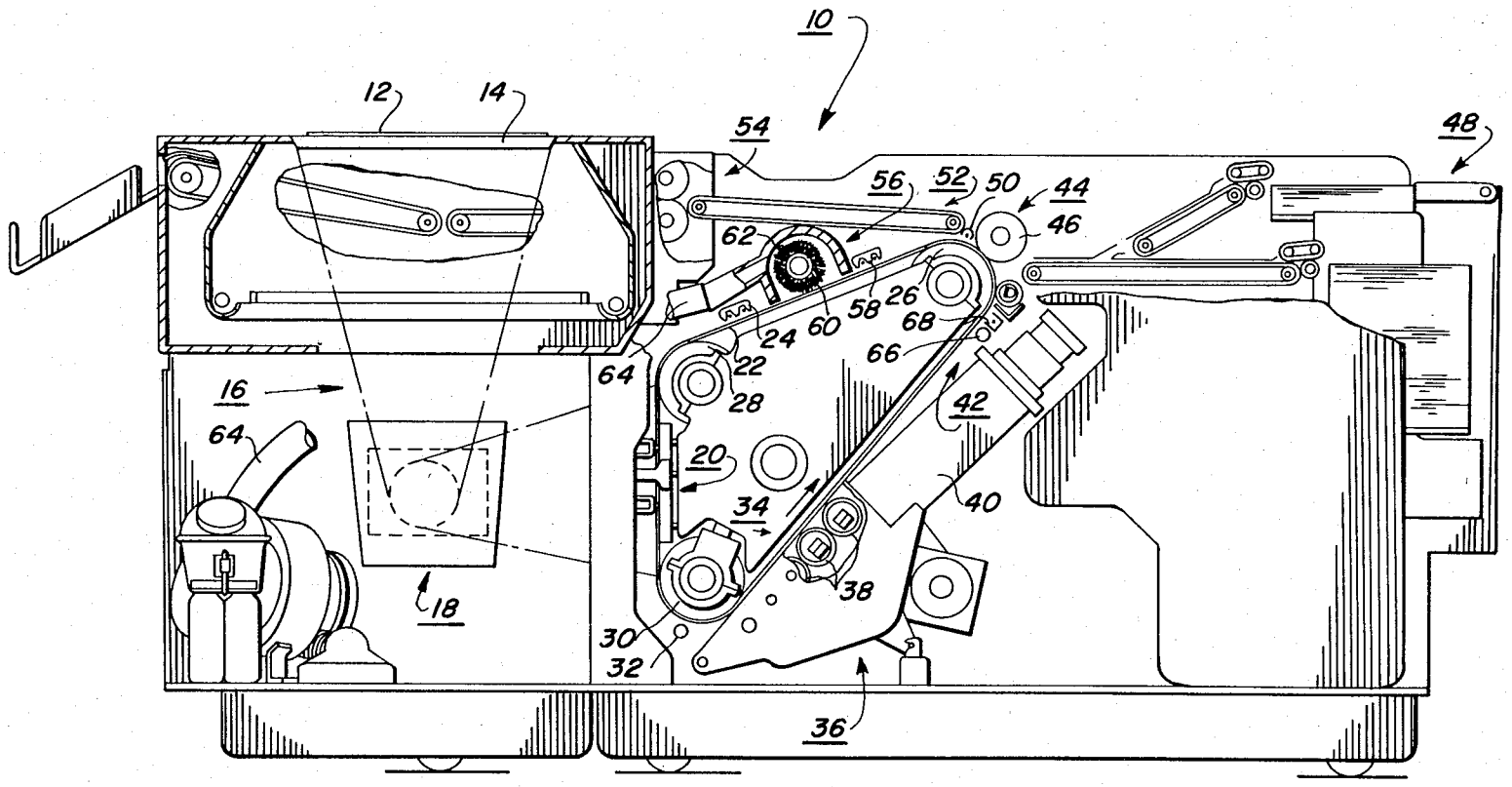
10
12
14
16
18
20
22
24
26
28
30
32
34
36
38
40
42
44
46
48
50
52
54
56
58
60
62
64
66
68

TRANSFER SYSTEM

BACKGROUND OF THE INVENTION

The present invention relates to xerographic reproduction machines, but more particularly to means for stabilizing a toner image on a photoreceptor prior to the image being transferred to a transfer member such as a sheet of paper.

In conventional xerography, a xerographic plate or photoreceptor comprising a layer of photosensitive insulating material affixed to a conductive backing is used to support electrostatic latent images. In the xerographic process, the photosensitive surface is electrostatically charged, and the charged surface is then exposed to a light pattern of the image being reproduced to thereby discharge the surface in the areas wherein light strikes the surface. The undischarged areas of the surface thus form an electrostatic charge pattern (an electrostatic latent image) conforming to the original pattern. The latent image is then developed by contacting it with a finely divided electrostatically attractable powder referred to as "toner". Toner is held on the image areas by the electrostatic charge on the surface. Where the charge is greater, a greater amount of toner is deposited. Thus, a toner image is produced in conformity with a light image of the copy being reproduced. Generally, the toner image is then transferred to a suitable transfer member (e.g., paper), and the image is affixed thereto to form a permanent record of the original document.

In the practice of xerography, the transfer member is caused to move in synchronized contact with the photosensitive surface during the transfer operation, and an electrical potential opposite from the polarity of the toner is applied to the side of the paper remote from the photosensitive surface to electrostatically attract the toner image from the surface to the paper.

It is common to treat the toner image prior to its transfer by depositing a charge onto the image and photoreceptor and sometimes subjecting the image to light afterward. Generally, the purpose of this treatment is to enhance transferability by increasing transfer efficiencies or to suppress the transfer of background toner particles. One known arrangement which is presently used in a commercial machine uses a DC positively biased AC pre-transfer corona generating device to deposit a charge onto the toner image on a positively charged photoreceptor after which the image is exposed to light. The purpose of this arrangement is to reduce the image holding charge to minimize or eliminate hollow characters while increasing the transfer efficiency. The result of this reduced holding charge, however, is toner dispersion and hence a blurred image. U.S. Pat. No. 3,984,182 discloses a DC biased AC pre-transfer corona generating device to increase transfer efficiency and suppress the transfer of background particles.

U.S. Pat. No. 2,959,153 discloses a negative pre-transfer corona generator which deposits negative ions onto a toner image on a positively charged photoreceptor. According to the patent, the effect of this is to decrease somewhat the magnitude of the image defining positive electrical charge stored in the non-conducting layer of the photoreceptor. In addition, it is stated that this treatment corrects an unfavorable condition known generally as "selenium fatigue". Again, the purpose of this arrangement is to increase transfer efficiency, not to stabilize the toner image. U.S. Pat. No. 3,784,300 discloses the combination of a DC pre-transfer corona generating device and lamp arranged such that the exposure of the photoreceptor to the lamp is subsequent and never simultaneous with the charging step. Canadian Pat. No. 989,930 discloses the combination of a D.C. pre-transfer corona generating device and lamp where the lamp again follows the corona generating device. Both of these arrangements are again intended to improve transfer efficiency and suppress the transfer of background particles, not to stabilize the toner image. Thus, what is needed is an arrangement which does not sacrifice transfer efficiency, but one which produces a strong holding field to stabilize the toner image and thereby significantly reduce toner dispersion.

SUMMARY OF THE INVENTION

It is a primary object of the present invention to stabilize a toner image before transfer without sacrificing transfer efficiency. To effect this, the toner image passes a pre-transfer station where the image is exposed to a lamp after which a charge is deposited onto the image and photoreceptor, the polarity of the charge being opposite to that of the photoreceptor. For example, if the photoreceptor is initially positively charged, a negative charge is deposited onto the image at this pre-transfer station.

BRIEF DESCRIPTION OF THE DRAWING

The FIGURE is a schematic sectional view of an electrostatic reproduction machine embodying the present invention.

DETAILED DESCRIPTION OF THE INVENTION

For a general understanding of an electrostatic reproduction machine in which the present invention may be incorporated, reference is made to the FIGURE. As in all electrostatic reproduction machines of the type illustrated, a light image of an original is projected onto the photosensitive surface of a xerographic plate to form an electrostatic latent image thereon. Thereafter, the latent image is developed with developing material comprising carrier beads and toner particles triboelectrically adhering thereto to form a xerographic powder image corresponding to the latent image on the photosensitive surface. The powder image is then electrostatically transferred to a transfer member such as a sheet of paper to which it may be fixed by a fusing device whereby the toner image is caused permanently to adhere to the transfer member.

In the illustrated machine 10, an original 12 to be copied is placed upon a transparent support plate 14 fixedly arranged in an illumination assembly indicated generally by the reference numeral 16. While upon the platen, the illumination assembly flashes light rays upon the original, thereby producing image rays corresponding to the informational areas on the original. The image rays are projected by means of an optical system 18 to an exposure station 20 for exposing the surface of a moving xerographic plate in the form of a flexible photoconductive belt or photoreceptor 22. In moving in the direction indicated by the arrow, prior to reaching the exposure station 20, that portion of the belt being exposed would have been uniformly charged to approximately 930 volts by a corona generating device 24 located at a belt run extending between the belt supporting rollers 26 and 28. The exposure station extends between the roller 28 and a third roller 30.

The exposure of the photosensitive surface of the belt to the light image discharges the surface in the areas struck by light whereby an electrostatic latent image remains on the belt in image configuration corresponding to the light image projected from the original on the support platen. As the belt continues its movement, the latent image passes a pitch fade-out lamp 32, and through a developing station 34 where a developing apparatus indicated generally by the reference numeral 36 is positioned. The latent electrostatic image formed on the photoreceptor is approximately 770 volts while the background areas surrounding the latent image is approximately 240 volts. The developing apparatus 36 comprises a plurality of magnetic brushes 38 which carry developing material to the surface of the upwardly moving belt 22. The magnetic brushes 38 are electrically biased by any suitable means such as that disclosed in U.S. patent application Ser. No. 440,880 filed 8 February 1974, the disclosure of the latter being incorporated by reference herein to the extent necessary. As the developing material is applied to the belt, toner particles in the development material are electrostatically attracted to the charged photosensitive surface to form a powder image (an electrostatic developed image), the polarity of the toner particles being opposite to that of the photosensitive surface. Toner is periodically and automatically dispensed into the developing apparatus 36 by a toner dispenser 40 in a manner to be described hereinafter, the toner dispenser being a conventional foam roller type dispenser as described in U.S. Pat. No. 3,724,422, the disclosure of the latter being incorporated by reference herein to the extent necessary.

The developed electrostatic image is transported by the belt 22 past a pre-transfer station 42 to a transfer station 44, where a sheet of paper is moved at a speed in synchronism with the moving belt in order to effect transfer of the developed image to the paper. Located at the transfer station 44 is a transfer roll 46 which is arranged on the frame of the machine to contact the back side of a sheet of paper as the latter is moved or fed between the belt and the transfer roll. The transfer roll 46 is electrically biased with sufficient voltage so that the developed image on the belt may be electrostatically attracted to the adjacent side of a sheet of paper as the latter is brought into contact therewith. The transfer roll 46 applies a charge to the entire sheet as it moves between the roll and the belt 22.

A suitable sheet transport mechanism transports sheets of paper seriatim from a paper handling mechanism indicated generally by the reference numeral 48 to the developed image on the belt as the same is carried around the roller 26.

As a sheet emerges from the transfer station 44, a charge is deposited thereon by a detack corona generating device 50 to lessen the electrostatic attraction between the photoreceptor 22 and the sheet so that the latter can be removed by a vacuum stripping and transport mechanism 52. The sheet is thereafter retained on the underside of the vacuum stripping and transport mechanism 52 for movement into a fuser assembly indicated generally by the reference numeral 54 wherein the powder image on the sheet is permanently affixed thereto. After fusing, the finished copy is discharged at a suitable point for collection. The toner particles remaining as residue on the photoreceptor 22 are carried by the belt to a cleaning apparatus 56. The cleaning apparatus 56 comprises a corona discharge device 58 for neutralizing charges remaining on the untransferred toner particles, a rotating brush 60 mounted within a housing 62, and a vacuum outlet 64.

The pre-transfer station 42 includes a pre-transfer lamp 66 which exposes the developed image and photoreceptor followed by a pre-transfer corona generating device 68 which deposits negative ions onto the developed image and photoreceptor as the latter moves past the pre-transfer station. In the example used herein, the photoreceptor 22 is positively charged and the pre-transfer corona generating device 68 deposits negative ions onto the developed image and photoreceptor. It should be understood that this invention also applies if a photoreceptor is negatively charged; in this situation the pre-transfer corona generating device would deposit positive ions onto the developed image and negatively charged photoreceptor. In the present example, the lamp 66 penetrates the developed image and reduces the positive charge holding the toner onto the photoreceptor 22, and also discharges the background area around the toner to a residual voltage of about 60 volts. After passing the lamp 66, the developed image passes under corona generating device 68 where a net negative charge is deposited onto the developed image and photoreceptor, thus increasing the negative charge on the toner forming the developed image, and also charging the area immediately around the developed image. The corona generating device 68 is a $-30\mu$ a D.C. biased $15\mu$ a A.C. device. Thus, a strong holding force is formed which stabilizes the developed image. As can be seen, the positive charge holding toner onto the photoreceptor 22 has been reduced while the negative charge on the toner forming the developed image has been increased and there is a strong negative charge surrounding the image. Thus, since like charges repel, a very stable image is produced since there is a relatively weak positive charge under the image, and a high negative charge around the negative image. Also, transfer efficiency does not suffer because the lamp 66 preceding the corona discharge device 68 serves to reduce the positive charge holding the image onto the photoreceptor.

While the invention has been described with reference to the structure disclosed, it is not confined to the details set forth, but is intended to cover such modifications or changes as may come within the scope of the following claims.

What is claimed is:

1. An improved process of treating a toner image charged to a first polarity on a photoreceptor charged to a second polarity prior to transferring the toner image to a transfer member, the process comprising:

(a) exposing the toner image and photoreceptor to light to at least substantially discharge the photoreceptor around the toner image and to reduce the charge on the photoreceptor holding the toner image on the photoreceptor, and then (b) depositing a net charge of the first polarity onto the toner image and photoreceptor.

2. An improved process for transferring a toner image charged to a first polarity from a photoreceptor charged to a second polarity to a transfer member, the process comprising:

(a) exposing the toner image and photoreceptor to light to at least substantially discharge the photoreceptor around the toner image and to reduce the charge on the photoreceptor holding the toner image on the photoreceptor, and then (b) depositing a net charge of the first polarity onto the toner image and photoreceptor, and then (c) transferring the toner image to the transfer member by bringing one side of the transfer member into contact with the toner image and applying a charge of the second polarity to the opposite side of the transfer member.

3. An improved apparatus for transferring a toner image charged to a first polarity from a photoreceptor charged to a second polarity to a transfer member, the apparatus comprising:

(a) means for exposing the toner image and photoreceptor to light to at least substantially discharge the photoreceptor around the toner image and to reduce the charge on the photoreceptor holding the toner image on the photoreceptor, (b) means for depositing a net charge of the first polarity onto the toner image and photoreceptor subsequent to exposure of the toner image and photoreceptor, and (c) means for transferring the toner image to the transfer member.

* * * * *